United States Patent [19]

Artynov et al.

[11] Patent Number: 5,031,699

[45] Date of Patent: Jul. 16, 1991

[54] METHOD OF CASING OFF A PRODUCING FORMATION IN A WELL

[76] Inventors: Vadim V. Artynov, Odintsovo, Mozhaiskoe shosse, 7, kv. 75, Moskovskaya oblast; Gabdrashit S. Abdrakhmanov, ulitsa Gogolya, 66, kv. 71; Rustam K. Ibatullin, ulitsa Gogolya, 66, kv. 49, both of Bugulma; Renat K. Muslimov, ulitsa Lenina, 5, kv. 11; Rashat K. Fatkullin, ulitsa Radischeva, 20, kv. 40, both of Almetievsk; Rashid A. Khabibullin, ulitsa Gogolya, 66, kv. 25, Bugulma; Yaroslav V. Vakula, ulitsa Lenina, 16, kv. 14, Almetievsk; Vitaly P. Filippov, ulitsa Gogolya, 47, kv. 2; Salikhzian Mingazov, ulitsa G. Uspenskogo, 69, kv. 3, both of Bugulma, all of U.S.S.R.

[21] Appl. No.: 555,504

[22] PCT Filed: Nov. 22, 1988

[86] PCT No.: PCT/SU88/00235

§ 371 Date: Aug. 2, 1990

§ 102(e) Date: Aug. 2, 1990

[87] PCT Pub. No.: WO90/05832

PCT Pub. Date: May 31, 1990

[51] Int. Cl.[5] ..... E21B 33/00

[52] U.S. Cl. ..... 166/285; 166/387; 166/207; 166/287

[58] Field of Search ..... 175/55, 230, 424; 166/287, 285, 369, 373, 374, 382, 387, 101, 115, 117.5, 117.6, 118, 122, 128, 129, 130, 153, 154, 155, 156, 207, 212, 242, 243

[56] References Cited

U.S. PATENT DOCUMENTS

| | | | |
|---|---|---|---|
| 2,479,394 | 8/1949 | Montgomery | 166/287 |
| 2,812,025 | 11/1957 | Teague et al. | 166/207 |
| 3,389,752 | 6/1968 | Lebourg | 166/387 |
| 3,593,795 | 7/1971 | Broussard, Sr. | 166/285 |
| 3,918,522 | 11/1975 | Suman, Jr. | 166/285 |
| 4,378,843 | 4/1983 | Suman, Jr. | 166/387 |
| 4,386,531 | 6/1983 | Heimgartner et al. | 73/155 |
| 4,440,226 | 4/1984 | Suman, Jr. | 166/285 |

FOREIGN PATENT DOCUMENTS

| | | |
|---|---|---|
| 911015 | 10/1982 | U.S.S.R. . |
| 1234587 | 5/1986 | U.S.S.R. . |

OTHER PUBLICATIONS

Yu. V. Vadetski, "Drilling oil and gas wells", 1973, Nedra/Moscow, pp. 346–348.

Neftyanoe khozyaistvo, N4, Apr. 1982, Nedra, Moscow, G. S. Abdrakhmanov et al., "Isolation of Absorption Zones with Steel Pipes Without Diminishing the Well Diameter", pp. 26–28.

*Primary Examiner*—Ramon S. Britts
*Assistant Examiner*—Roger J. Schoeppel
*Attorney, Agent, or Firm*—Lilling and Lilling

[57] ABSTRACT

The method of casing off a producing formation in a well includes drilling into the producing formation (19) and reaming the borehole in the producing formation zone. Then the producing fomation (19) is shut off with a fluid-impervious envelope (14) of profile pipes reamed in the process of their setting by building up a pressure drop thereacross. Then the flow casing string (5) is run into the well and cemented, followed by re-exposing the producing formation (19). The running-in of the flow casing string (5) is terminated upon its having entered the upper part of the fluid-impervious envelope (14).

4 Claims, 1 Drawing Sheet

METHOD OF CASING OFF A PRODUCING FORMATION IN A WELL

TECHNICAL FIELD

The present invention relates to methods of welldrilling, and more particularly it relates to a method of casing off a producing formation in a well.

The invention can be employed to the utmost effect for protection of a producing formation against pollution by the flushing fluid and cement slurry when running casing in the well (casing-in process).

In the process of well-drilling and casing-in, the borehole fluids including the flushing fluid and the cement slurry find their way into a producing formation, adversely affecting its reservoir properties, which prolongs the well completion period, and involves additional work on restoring the reservoir properties of the formation, incurring extra labor and material inputs and increased costs of the associated equipment and the use transport facilities.

PRIOR ART

There is known a method of casing off a producing formation in a well, including drilling into the producing formation, running in a flow casing string, cementing the latter above the producing formation and perforating the uncemented portion of the flow casing string in the pay sesction, i.e. in the producing formation zone, thus re-exposing the producing formation (Yu. V. Vadetski, "Drilling oil and gas wells", 1973 , Nedra/-Moscow/, pp. 346–348).

A serious drawback of this method is that it fails to ensure reliable isolation of the producing formation from the underlying strata, as the cementing of the casing string is carried out above the producing formation.

Another shortcoming of the known method is its unsuitability in cases where the producing formations display a tendency towards caving-in, as this involves the filling of the annulus between the flow casing string and the producing formation by caved-in rock, which impairs the filtration of the product from the formation.

There is further known a method of casing off a producing formation in a well (SU,A, No. 911015), including the steps of drilling into the formation and perforating it, casing it off with a fluid-impervious envelope of profile pipes which are reamed in the course of their setting by building up a pressure drop the reacross, and running through them and cementing a flow casing string of a smaller diameter in comparison with the target diameter, followed up by the re-exposure of the producing formation.

A major drawback of this method of the prior art is the increased thickness of the isolating layer formed by the walls of the fluid-impervious envelope and of the flow casing string, and by the cement ring therebetween, which complicates the re-exposure of the formation and impairs the efficiency of the filtration of the product from the formation into the well. The setting of the flow casing string of a reduced diameter decreases the filtration area of the formation and thus brings down the yield of the well. Furthermore, the method of the prior art involves additional pulling and running-in operations of setting up the fluid-impervious envelope, which incurs extra inputs of time, materials and labor.

The present invention has for its object the creation of a method of casing off a producing formation in a well, providing for increasing the area of filtration while at the same time reducing the thickness of the isolating layer separating the producing formation from other formations.

DISCLOSURE OF THE INVENTION

This object is attained in a method of casing off a producing formation in a well, including the steps of drilling into the producing formation, shutting off the producing formation with a fluid-impervious envelope of profile pipes which are reamed in the process of their setting by building up a pressure drop thereacross, running in and cementing a flow casing string, and re-exposing the producing formation, in which method, in accordance with the present invention, the borehole is reamed in the producing formation zone prior to the setting of the impervious envelope, and the running-in of the flow casing string is terminated after the string enters the upper part of the impervious envelope.

The present invention provides, owing to the increased diameter of the well over the pay section and the reduction of the thickness of the isolating layer due to the flow casing being run only into the upper part of the impervious envelope and the cement ring in the zone of the producing formation having been eliminated, for stepping up the area of filtration and the yield of the product from the formation.

It is expedient that the reaming of the borehole in the producing formation zone should be performed concurrently with its being drilled into. This provides for avoiding additional double trips associated with running into the well a tool for reaming the borehole in the drilled-in formation zone.

According to another embodiment of the present invention, the fluid-impervious envelope is run in and set in the producing formation zone jointly with the flow casing strings.

This provides for avoiding additional double trips involved in running the impervious envelope into the well on drill pipes.

In the preferred embodiment of the method according to the present invention, the reaming of the borehole in the producing formation zone is affected to 1.5 to 2.0 times the outer diameter of the flow casing string.

The reaming of the borehole diameter in the producing formation zone to less than 1.5 times the diameter of the flow casing string is ill-advisable on account of its increasing the filtration of the fluid from the formation into the well but insignificantly, whereas the reaming of the borehole to more than 2 times the diameter of the flow casing string is practically not feasible on account of the limitations brought about by the physical properties of the fluid-impervious envelope made of profile pipes whose expansion is not unlimited.

SUMMARY OF THE DRAWINGS

Other objects and advantages of the present invention will be made apparent in the following description of an example of its embodiment, with reference being made to the accompanying drawings, wherein.

PREFERRED EMBODIMENT OF THE INVENTION

Figures 1, 2, 3, 4:
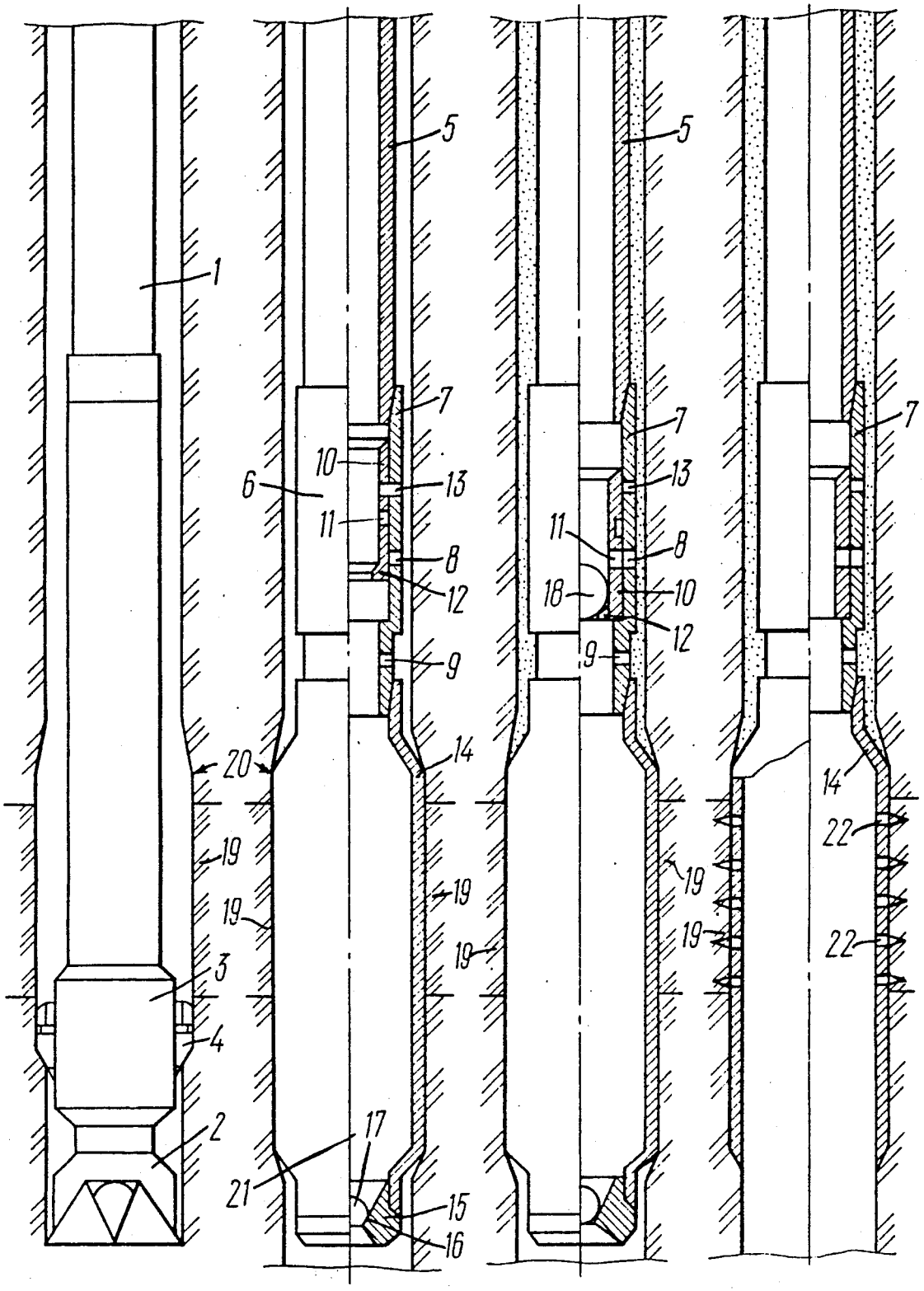
FIG. 1 illustrates the operation of reaming the borehole in the producing formation zone.
FIG. 2 illustrates the operation of setting an impervious enveloped in the reamed portion of the borehole.
FIG. 3 illustrates the process of cementing the flow casing string.
FIG. 4 illustrates the portion of the casing string with the impervious envelope, prepared for production.

The method of casing off a producing formation in a well is carried out in the following succession of major steps.

Prior to drilling into the producing formation, an expander (reamer) is mounted above the drilling bit, and the formation is drilled into concurrently with its reaming to a diameter 1.5 to 2.0 times the outer diameter of the flow casing string to be run into the well.

Then the drill pipe string with the bit and reamer is pulled out, and a flow casing string is run into the well, complete with means for its cementing and with a fluid-impervious envelope of profile pipes attached to its bottom end. The running-in of the string is terminated when the impervious envelope is set against the reamed zone of the producing formation. Then the pressure of the fluid pumped into the profile pipes is employed to expand the impervious envelope till firm contact with the wall of the reamed zone of the producing formation, whereafter the flow casing string is cemented and the producing formation is re-exposed by perforating the impervious envelope according to any known suitable technology.

The method is performed by using an arrangement including a drill pipe string 1 (FIG. 1) with a drilling bit 2 on its lowermost end, underlying a reamer 3 with projectable elements 4. Another set of the equipment to be employed in implementing the disclosed method includes a flow casing string 5 (FIGS 2 and 3) with a device 6 for its cementing forming an extension of the lowermost end of the flow casing string 5. The device 6 comprises a sub 7 with lateral openings 8 and 9 made through its wall, receiving inside it a sleeve 10 with a lateral opening 11 and a seat 12, locked against axial displacement by a pin 13. A fluid-impervious envelope 14 is attached to the lowermost end of the sub 7, ending at its downmost end with a shoe 15 with a seat 16 and a ball valve 17. Another ball valve 18 (FIG. 3) is provided for conducting the process of cementing the casing string 5, cooperating with the seat 12 of the sleeve 10.

The following examples are intended for better understanding of the essence of the method of casing off a producing formation in a well in accordance with the present invention.

As the well is drilled with the bit 2 (FIG. 1) mounted on the drill pipe string 1, a producing formation 19 is drilled into, and simultaneously the borehole in the producing formation zone is reamed by the projectable elements 4 of the reamer 3 overlying the bit 2, reaching beyond the confines of the producing formation 19 by 10–20 m both in the upward and downward directions. Then the drill pipe string 1 is pulled out of the well, and the flow casing string 5 (FIG. 2) is run into the well, having attached to its lowermost end by means of the sub 7 the impervious envelope 14 in the form of longitudinally corrugated steel profile pipes, provided at its lowermost end with the shoe 15 with the seat 16 and the ball valve 17. As it can be seen in FIG. 2, the sub 7 forming, in fact, the extension of the flow casing string 5, has its lowermost end entering the uppermost end of the impervious envelope 14 only by an extent providing for their reliable joining. As the impervious envelope 14 reaches the reamed zone 20 of the producing formation 19, the running-in of the flow casing string 5 is terminated. As the flow casing string 5 has been lowering, the borehole fluid has been raising the ball valve 17 in the shoe 15 and filling up the internal space 21 (FIG. 2) of the envelope 14. Then a fluid, e.g. the drilling mud, is pumped via the flow casing string 5, into the internal space 21 (FIG.2) to a 12–14 MPa pressure, to expand the fluid-impervious envelope 14 of profile pipes until it closely hugs the walls of the reamed zone 20, reliably separating the producing formation 19 from other formations. The pressure of the pumped fluid maintains the ball valve 17 in the shoe 15 on its seat 16, i.e. in the closed position.

Additional sealing away of the space beyond the fluid-impervious envelope 14 can be attained by using a sealing paste filling the grooves between the corrugations of the profile pipes of the impervious envelope 14.

Following complete straightening of the impervious envelope 14, the fluid pressure in the space 21 is relieved, and the ball valve 18 is dropped into the flow casing string 5, as shown in FIG. 3, to become seated on the seat 12 in the sleeve 10 mounted in the flow passage of the sub 7. The fluid pressure inside the flow string 5 is built up once again, its effect shearing off the lock pins 13 retaining the sleeve 10 against axial displacement, and the sleeve 10 is driven into its lowermost position, as shown in FIG. 3. The fluid from the internal space 21 (FIG. 2) is forced via the lateral opening 9 into the annulus, while the lateral openings 11 and 8, respectively, in the sleeve 10 and sub 7 become aligned. This is followed by cementing the flow casing string 5 by any suitable conventional technique, using appropriate cementing units (not shown).

Following the pumping in of the design quantity of the cement slurry and affording it the time to set beyond the flow casing string 5, the components 10, 12 and 18 inside the flow casing string 5 are drilled away, the producing formation 19 is re-exposed in any suitable known manner, e.g. by perforating the envelope 14, and the yield of the product through the perforations 22 (FIG. 4) thus formed is established.

INDUSTRIAL APPLICABILITY

The present invention can be employed for protecting producing wells against pollution with the borehole fluid and cement slurry in the process of casing-in of the well, and also for stepping the oil yield of producing formations.

We claim:

1. A method of casing off a producing formation in a well, including the steps of drilling into the producing formation (19), shutting off the producing formation (19) with a fluid-impervious envelope (14) of profile pipes which are reamed in the process of their setting by building up a pressure drop thereacross, running in and cementing a flow casing string (5), and re-exposing the product formation (19), characterized in that the borehole is reamed in the zone of the producing formation (19) prior to the setting of the fluid-impervious envelope (14) and the running-in of the flow casing string (5) is terminated upon its having entered the upper part of the fluid-impervious envelope (14).

2. A method as claim 1, characterized in that the reaming of the borehole in the zone of the producing formation (19) is performed concurrently with the drilling into the producing formation (19).

3. A method as claimed in claim 1, characterized in that the running-in and setting of the fluid-impervious envelope (14) in the zone of the producing formation (19) is performed jointly with the running-in of the flow casing string (5).

4. A method as claimed in claim 1 or 2, characterized in that the reaming of the borehole in the zone of the producing formation (19) is effected to 1.5 to 2.0 times the outer diameter of the flow casing string (5).

* * * * *